US005379899A

United States Patent [19]

Thurell

[11] Patent Number: 5,379,899

[45] Date of Patent: Jan. 10, 1995

[54] DISPENSER FOR MEDICAL PREPARATIONS INCLUDING LOCKING MEANS

[75] Inventor: Peter Thurell, Stocksund, Sweden

[73] Assignee: Item Development AB, Stocksund, Sweden

[21] Appl. No.: 146,027

[22] PCT Filed: Jun. 16, 1992

[86] PCT No.: PCT/SE92/00426

§ 371 Date: Nov. 8, 1993

§ 102(e) Date: Nov. 8, 1993

[87] PCT Pub. No.: WO92/22277

PCT Pub. Date: Dec. 23, 1992

[30] Foreign Application Priority Data

Jun. 17, 1991 [SE] Sweden ..... 9101862

[51] Int. Cl.[6] ..... B65D 83/04

[52] U.S. Cl. ..... 206/538; 206/1.5; 206/539

[58] Field of Search ..... 206/538, 539, 534, 1.5; 116/308

[56] References Cited

U.S. PATENT DOCUMENTS 4,038,937 8/1977 Moe .

4,062,445 12/1977 Möe ..... 206/1.5

4,872,559 10/1989 Schoon ..... 206/538

FOREIGN PATENT DOCUMENTS 0250636 1/1988 European Pat. Off. .

2575730 7/1986 France .

433071 5/1984 Sweden .

*Primary Examiner*—Bryon P. Gehman

*Attorney, Agent, or Firm*—Burns, Doane, Swecker & Mathis

[57] ABSTRACT

A dispenser for medical preparations includes a rectangular box having a bottom and a top portion. The top portion has a plurality of apertures, each aperture covered by a lid that is slidable in grooves in the top portion so that the lid is extractable in one direction. An insert having several rows of compartments for medical preparations is adapted to be inserted in the box so that each row is positioned under an aperture for access to the compartments through the corresponding overlying aperture. A cover which closes an opening in a side of the box is removable to allow the insertion and removal of the insert through the opening. A locking rod locks the lids in a position closing the apertures, and unlocks all of the lids at the same time. The cover is also locked in a closing position by the locking rod and is removable only upon actuation of the locking rod for unlocking the lids.

20 Claims, 3 Drawing Sheets

DISPENSER FOR MEDICAL PREPARATIONS INCLUDING LOCKING MEANS

The present invention relates to a dispenser for medical preparations.

The prior-art technique is represented by U.S. Pat. Nos. 4,038,987, 4,062,445 and EP-A1-0,250,636. All of them are incorporated in this specification by reference. The main problem according to EP-A1-0,250,636 is the fact that known dispensers (U.S. Pat. No. 3,537,422) are not childproof. To solve the problem; this publication suggests a construction similar to the one according to U.S. Pat. No. 4,062,445 and, moreover, an openable side cover (11) which by means of a shoulder (14) can be caused to engage an edge (15) of the dispenser casing so as to close a lateral opening (21) in the dispenser casing, after an insert (10) formed with compartments for medical preparations has been inserted the casing.

According to the invention, it has now appeared that the side cover is not childproof in a reliable manner. There are good reasons indicating that a child can concentrate on opening the side cover and manage to do so. The cover should not be so difficult to remove that also adults, e.g. weak old people, cannot remove it to take out the insert for the purpose of refilling it with preparations.

The object of the invention is to provide a dispenser which has improved childproof qualities, but at the same time does not make it difficult for adults to reach the insert through a lateral opening in the dispenser.

The dispenser according to the present invention thus is of the type described in EP-A1-0,250,636, i.e. comprising a rectangular box having a bottom and a top portion in which a plurality of recesses are formed, each covered by a lid that is slidable in grooves in said top portion so as to be extractable in one direction; an insert having several rows of compartments, each row being positioned under the corresponding recess in the top portion and the compartments being arranged to accommodate said medical preparations; a cover which closes an opening in one of the sides of the box and is removable to allow insertion and removal of the insert through said opening; and a locking means for locking all the lids in the closed positions thereof and for unlocking all the lids are the same time.

According to the invention, the cover is removable only after actuation of the locking means for said unlocking of the lids.

The invention is based on the knowledge that children find it more difficult than adults to coordinate thoughts and actions. The attention of a child is in most cases concentrated on one thing at a time. The arrangement according to the invention requires two actions for opening the cover, viz. actuation of the locking means for unlocking the cover, and displacement of the cover for access to the lateral opening of the box.

An embodiment of the invention will now be described in more detail with reference to the accompanying drawings.

Figure 1:
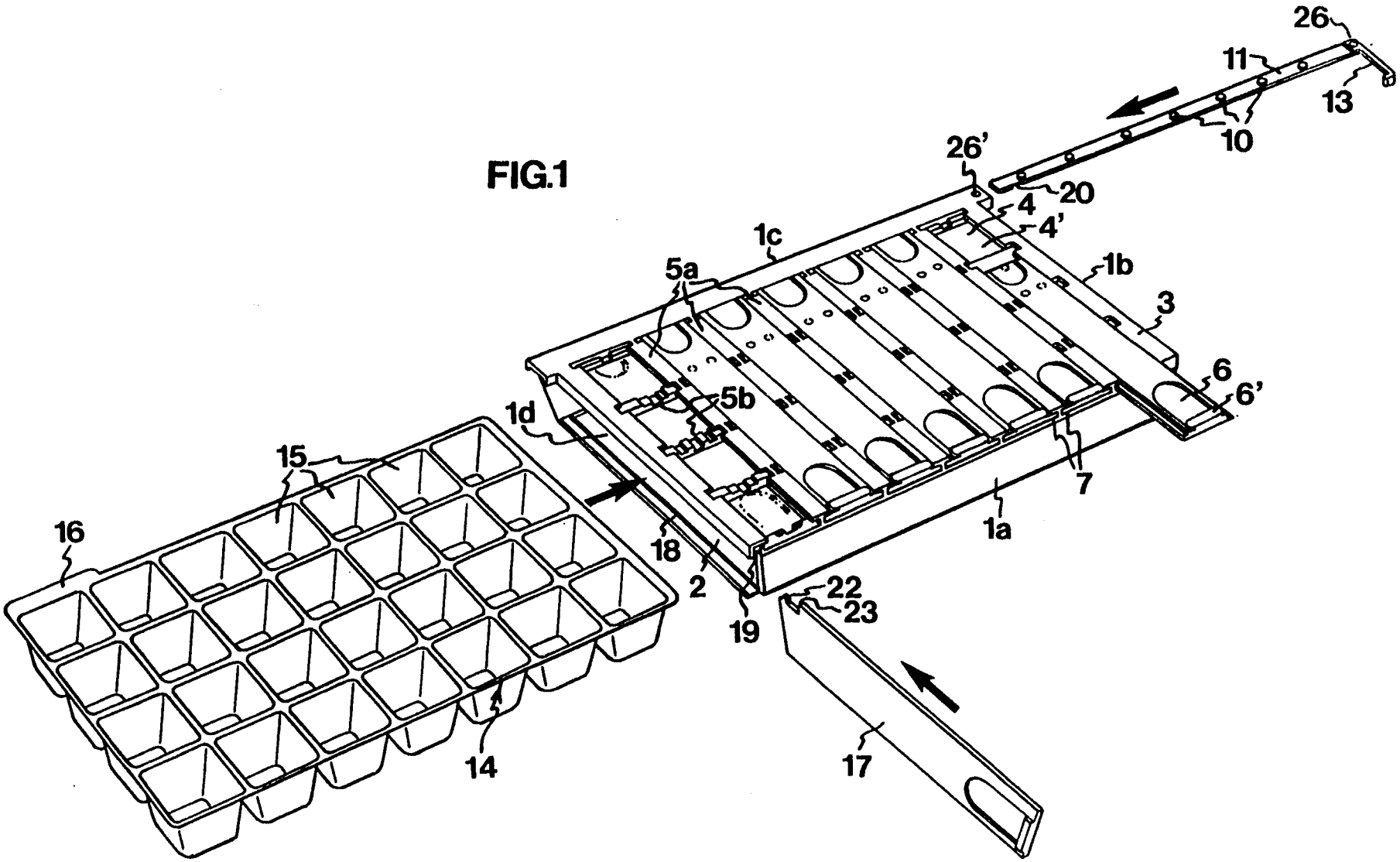
FIG. 1 is an exploded view of the dispenser according to the invention.

The casing or box 1 of the dispenser has four sides 1*a*–1*d*, the side 1*d* being openable, whereas the remaining sides are closed; one bottom 2 and one top portion 3. The top portion is formed with a plurality of apertures 4 having inlets 4' which are defined by upper and lower ribs 5*a*, 5*b* which are perpendicular to each other and extend between the sides 1*a* and 1*c* and, respectively, between the sides 1*b*and 1*d*. The apertures can be covered by transparent plastic lids 6 which are slidable in grooves 7 formed at the intersection of the ribs 5*a*, 5*b*. The top face of the ribs 5*b* cooperates frictionally with projections 8 formed on the lower side of the lids 6. This arrangement renders the sliding movement of the lids 6 past the ribs 5*b* more difficult so that the inlets 4' can be reached but with some difficulty, as the lids are manually displaced so as to uncover the inlets. In one longitudinal edge-at the front end of the lids 6 there is formed a recess 9 which cooperates with upwardly directed projections 10 on a locking rod 11 which runs along the side 1*c* in a groove 12 opening downwards and at the ends and formed in the lower side of the top portion 3, the front end of the lids extending into said groove, when the lids are in their position locked by means of the locking rod 11. In this position, the projections 10 each engage a recess 9. The locking rod 11 is fitted with an actuating button 13 which is available on the outside of the box. By means of this button, the locking rod can be actuated for releasing the engagement between the recesses 9 and the projections 10, which actuation is performed by pressing the actuating button 13.

The box houses an insert 14 with upwardly open containers or compartments 15 which are positioned in rows and columns and whose apertures are each directed to an inlet 4'. The insert 14 is removable from the box through the open side 1*d* of the box and reinsertable in the box through this side in one orientation only, for which purpose the insert is formed with projections 16, and corresponding projections are to be found in the box.

The compartment accommodates medical preparations to be administered several times a day seven days a week. In the embodiment shown, preparations can be stored for administration on four different occasions a day for seven days.

Figure 2:
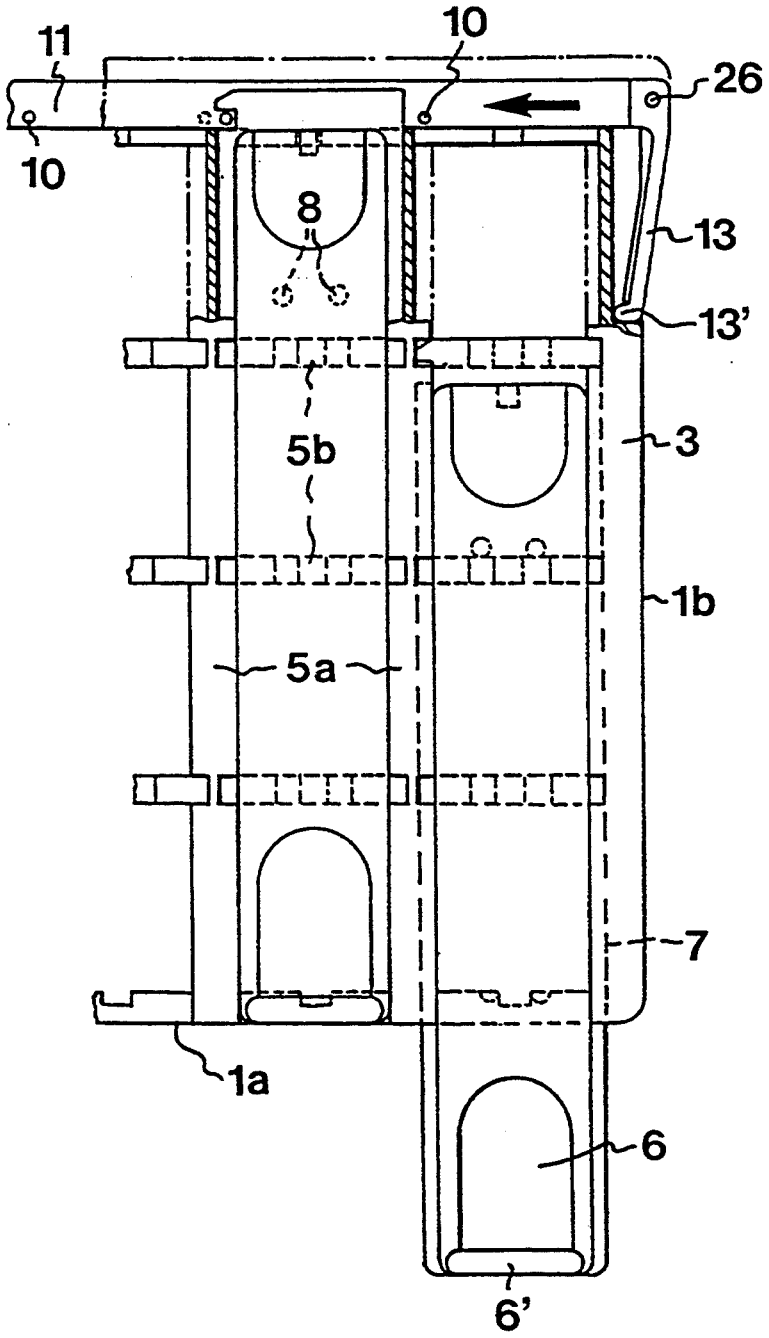
FIG. 2 is a part-sectional view of a broken-away part of the dispenser.

It is evident from that stated above and from the drawings that for access to the preparations in the compartments 15, first the rod 11 must be pressed by means of the push button 13 in the direction of the arrow indicated in FIG. 2, so that the engagement between the projections 10 and the recesses 9 is released. After this release, the selected lid 6 can be pulled outwards (by means of the handle 6') so as to uncover the inlet 4' of the selected compartment. The locking rod 11 is made of a resilient plastic, so that when the pressure exerted on the actuating button 13 having a lever point 13' is released, the engagement between the projections 10 of the untouched lids and the recesses 9 is automatically reinstated.

According to the invention, the open side 1*d* of the box is closable by means of a cover 17. The cover is slidable in a groove 18 in the bottom 2 and a corresponding groove 19 in the lower side of the top portion 3. The front end of the cover is formed with cooperating means for locking engagement with corresponding means fitted on the locking rod 11. Said cooperating means are arranged to be unlocked only on actuation of the locking rod for opening the lids 6.

Figure 3:
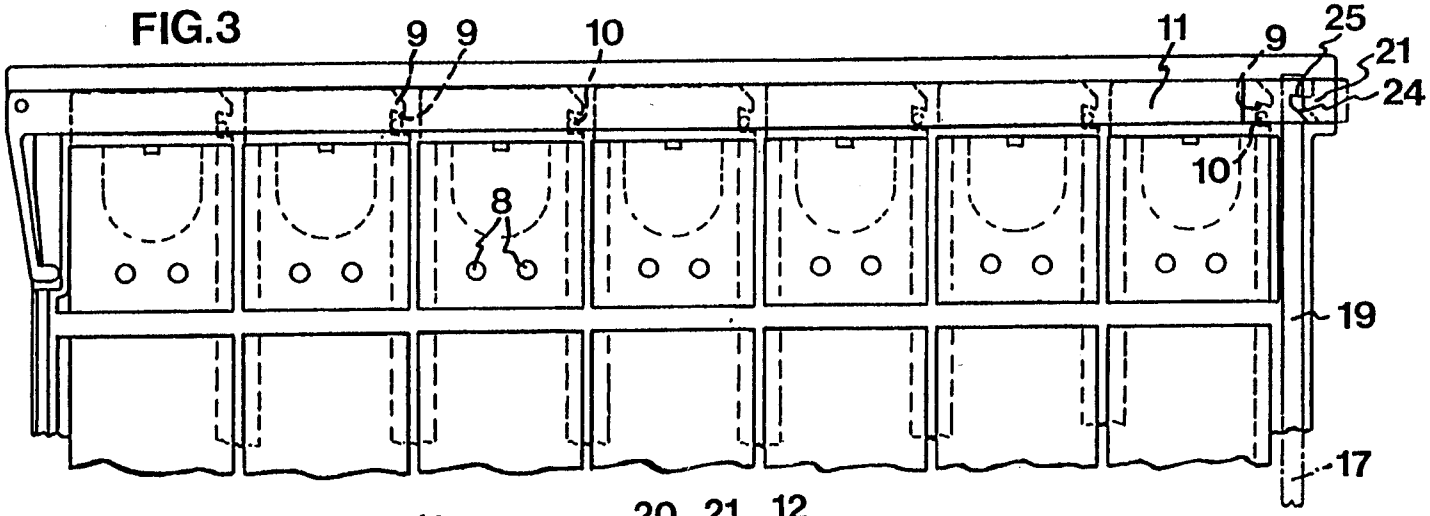
FIG. 3 is a bottom view of the top portion of the dispenser, with certain parts broken away.

First of all, reference is now made to FIG. 3. For said engagement, the locking rod 11 is formed with a recess 20 in its lower side at the opposite end relative to the actuating button 13. In this recess 20 there extends a shoulder 21 which is adapted to cooperate with a shoulder 22 projecting from a recess 23 in the upper longitudinal edge of the cover 17 at the front end thereof. The shoulder 21 has a cam surface 24 which is arranged, during displacement of the cover 17 to its locked position, to guide the shoulder 22 which presses the locking rod 11 in the lid-opening direction, into engagement with an abutment surface 25 formed on the shoulder, said engagement being brought about by the resilient return of the locking rod to the lid-locking position, after the shoulder 22 has left the cam surface 24. The engagement between the shoulder 22 and the abutment surface 25 is releasable by the press actuation of the actuating button 13 of the locking rod, as described above, one hand pulling the cover 17 away from the opening 1*d*, while this press actuation is performed by the other hand.

Figure 4:
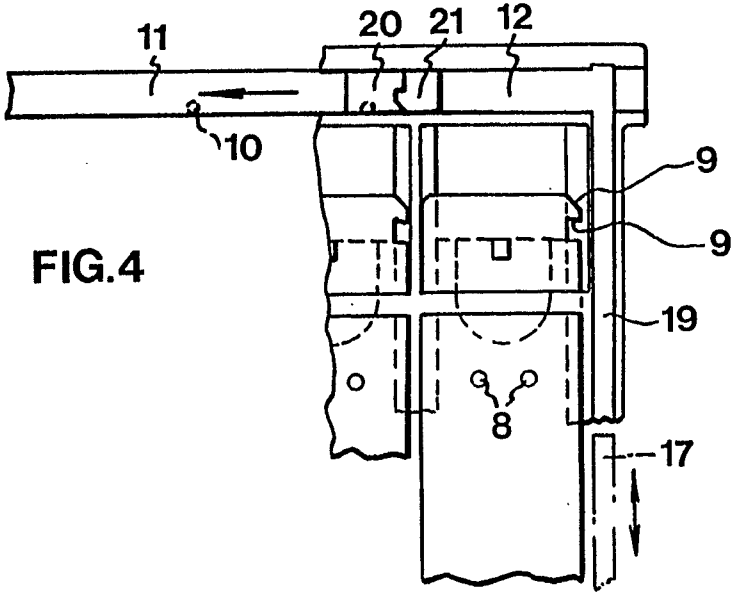
FIG. 4 is a bottom view of part of the top portion after opening the cover, the locking means being partly extracted.

If, while the locking rod 11 is kept pressed in the direction of releasing the lids and the cover, all lids 6 and the cover 17 are pulled outwards in the direction for opening the side 1*d* and the recesses 4, the locking rod 11 can be removed-from its groove 12 and from the box, as is apparent from the Figures (especially FIG. 4) said removal being carried out after releasing the pressure exerted on the actuating button 13 in that the rod is pulled in the direction opposite to the pressing direction. Such dismounting of the locking rod can come into question when an adult wants to avoid the childproof effect of the locking rod.

Through holes 26 in the locking rod 11, and 26' in the top portion, which correspond with each other, a tamper-proof sealing wire, e.g. of the type fixing a price tag to clothes, can be laid, which can be carried out in e.g. the chemistry where the insert 14 is filled with medical preparations.

It will be appreciated that the inventive principle is also applicable to a dispenser having a separate tray adapted to receive the insert 14 and be pulled out together therewith for refilling. Such an arrangement is disclosed in U.S. Pat. No. 4,038,937. The term cover in the specification and claims is intended also to comprise the corresponding side wall of such a tray.

I claim:

1. A dispenser for medical preparations, comprising:

a rectangular box (1) having a bottom (2) and a top portion (3) in which a plurality of apertures (4) are formed;

a plurality of lids, the lids having a closed position that closes a plurality of apertures, each lid (6) being slidable in grooves (7) in said top portion (3) so as to be extractable in one direction;

an insert (14) having several rows of compartments (15), each row being positioned under an aperture (4) in said box, each aperture allowing access to a compartment positioned under the aperture, and the compartments being arranged to accommodate medical preparations;

a cover (17) which closes an opening (1*d*) in a side of the box and is removable to allow insertion and removal of the insert (14) through said opening;

locking means (11) for locking all the lids (6) in the closed positions therefor, and for unlocking all the lids at the same time, and;

cooperating means on the cover that engages the locking means to lock the cover in a closed position in the opening and permits removal of the cover only after actuation of the locking means (11) for said unlocking of the lids (6).

2. The dispenser as claimed in claim 1, wherein said locking means (11) and said cover (17) are formed with blocking means (21, 22) which cooperate with each other for closing the cover.

3. The dispenser as claimed in claim 2, characterised in that said blocking means (21, 22) includes a shoulder formed on each of the cover and the locking means.

4. The dispenser as claimed in claim 3, wherein said locking means (11) is a rod which is fitted with a pressure-actuating button (13) and in whose lower side there is formed a recess (20) in which the shoulder (21) of said locking means extends, and that the shoulder (22) of said cover (17) projects from the upper edge surface of the cover.

5. The dispenser as claimed in claim 2, wherein said locking means (11) includes a pressure actuated button counteracted by a spring.

6. The dispenser as claimed in claim 2, wherein said cover (17) is a plate.

7. The dispenser as claimed in claim 2, wherein said cover (17) is a side wall of a tray in which the insert (14) is positionable.

8. The dispenser as claimed in claim 1, wherein said cooperating means includes a shoulder respectively formed on each of the cover and the locking means.

9. The dispenser as claimed in claim 8, wherein the shoulder (21) of said locking means (11) has a guiding surface (24) for the shoulder (22) of said cover (17).

10. The dispenser as claimed in claim 8, wherein said locking means (11) includes a pressure actuated button counteracted by a spring.

11. The dispenser as claimed in claim 8, wherein said locking means (11) includes a pressure actuated button counteracted by a spring.

12. The dispenser as claimed in claim 8, wherein said cover (17) is a plate.

13. The dispenser as claimed in claim 8, wherein said cover (17) is a side wall of a tray in which the insert (14) is positionable.

14. The dispenser as claimed in claim 8, wherein said locking means (11) is a rod which is fitted with a pressure-actuating button (13) and in whose lower side there is formed a recess (20) in which the shoulder (21) of said locking means extends, and that the shoulder (22) of said cover (17) projects from the upper edge surface of the cover.

15. The dispenser as claimed in claim 14, wherein the shoulder (21) of said locking means (11) has a guiding surface (24) for the shoulder (22) of said cover (17).

16. The dispenser as claimed in claim 14, wherein said cover (17) is a plate.

17. The dispenser as claimed in claim 14, wherein said cover (17) is a side wall of a tray in which the insert (14) is positionable.

18. The dispenser as claimed in claim 1, wherein said locking means (11) includes a pressure actuated button counteracted by a spring.

19. The dispenser as claimed in claim 1, wherein said cover (17) is a plate.

20. The dispenser as claimed in claim 1, wherein said cover (17) is a side wall of a tray in which the insert (14) is positionable.

* * * * *